US009411355B2

(12) United States Patent
Cocetta

(10) Patent No.: US 9,411,355 B2
(45) Date of Patent: Aug. 9, 2016

(54) CONFIGURABLE SLOPE TEMPERATURE SENSOR

(71) Applicant: Infineon Technologies Austria AG, Villach (AT)

(72) Inventor: Franco Cocetta, Premariacco (IT)

(73) Assignee: Infineon Technologies Austria AG, Villach (AT)

( * ) Notice: Subject to any disclaimer, the term of this patent is extended or adjusted under 35 U.S.C. 154(b) by 211 days.

(21) Appl. No.: 14/334,654

(22) Filed: Jul. 17, 2014

(65) Prior Publication Data

US 2016/0018839 A1 Jan. 21, 2016

(51) Int. Cl.

| | |
|---|---|
| ***G05F 1/10*** | (2006.01) |
| ***G05F 3/30*** | (2006.01) |
| ***G05F 3/22*** | (2006.01) |

(52) U.S. Cl.
CPC . *G05F 3/30* (2013.01); *G05F 3/225* (2013.01)

(58) Field of Classification Search
CPC ..... G05F 3/225; G05F 3/30
See application file for complete search history.

(56) References Cited

U.S. PATENT DOCUMENTS 8,710,912 B2 * 4/2014 Marinca ..... G05F 3/30 327/539
8,922,190 B2 * 12/2014 Wu ..... G05F 1/10 323/297

* cited by examiner

*Primary Examiner* — Jeffrey Zweizig
(74) *Attorney, Agent, or Firm* — Eschweiler & Associates, LLC

(57) ABSTRACT

Representative implementations of devices and techniques provide a configurable slope of a voltage response of a band-gap-based temperature sensor circuit. The slope and/or a translation of the voltage response may be configured by current domain operations at a strategic node.

25 Claims, 12 Drawing Sheets

CASE WITH DIODES

CASE WITH
BIPOLAR TRANSISTORS

CONFIGURABLE SLOPE TEMPERATURE SENSOR

BACKGROUND

A bandgap or base-emitter voltage is often used as a reference voltage for temperature sensor circuits, over-temperature detection, temperature independent current generation, and the like. For example, a bandgap or base-emitter based current generator (such as a proportional-to-absolute-temperature (PTAT) current generator) may be converted to a voltage generator, where the output voltage is representative of the ambient temperature, for example. Such an arrangement may be applied as a temperature sensor with an analog voltage output.

When using such a temperature sensor in various applications, it is generally desirable to fit the output voltage of the temperature sensor to a desired slope. For example, it may be desirable for the output of the temperature sensor to have a particular voltage corresponding to the lowest temperature of the range of interest and for the output to have another voltage corresponding to the highest temperature of the range of interest. Additionally or alternatively, it may be desirable for the output voltage to conform to a particular slope of voltage per increment of temperature measured, or the like. Generally, a shifting circuit is designed to fit the output voltage to the desired slope, and is implemented with the temperature sensor circuitry.

However, in many cases, the desired slope is not independent of the analog output voltage at a given temperature point. Instead, the temperature slope is proportional to the voltage value at a temperature point. Consequently, the supply voltage of the circuit may need to increase as the temperature slope increases, increasing the needed supply headroom of the circuit. Additionally, the use of the shifting circuit along with a dedicated reference voltage increases the circuit area and complexity of the temperature sensor.

Further, additional errors may be introduced when the temperature sensor is implemented in CMOS technology. Generally, with CMOS technology, the PTAT current is generated from the ground line, so a current mirror is used to redirect the generated current from the supply to the ground, and a resistance is used to convert the current to a voltage. These additional conversion steps have a potential to introduce additional errors to the accuracy of the sensor output.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure.

DETAILED DESCRIPTION

Overview

Figure 1:
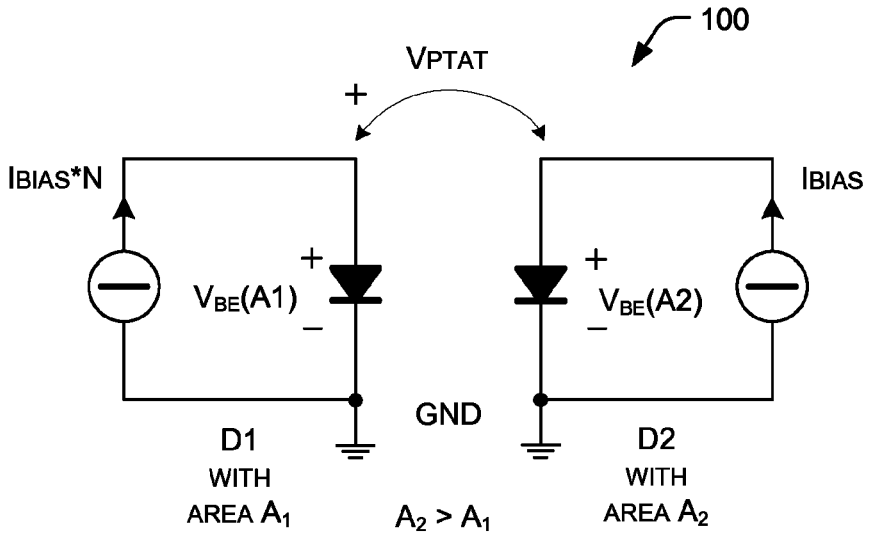
FIG. 1 includes a pair of schematic diagrams illustrating two examples of a circuit to obtain a $V_{PTAT}$ voltage.
Figure 1:
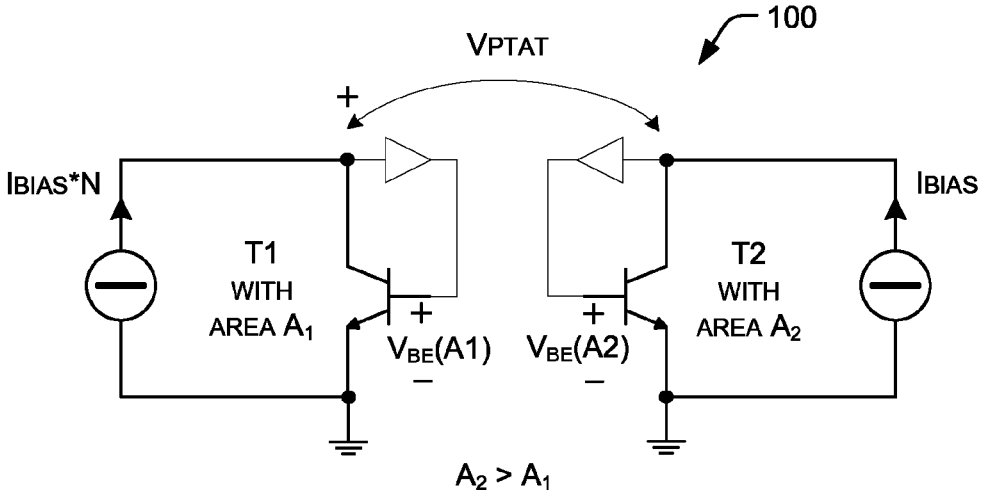

Representative implementations of devices and techniques provide a configurable output response for a temperature sensor circuit (including a bandgap-based or base-emitter based temperature sensor circuit, over-temperature protection circuit, or the like). In many cases, at least a portion of the output voltage response of the temperature sensor may be described using an equation for a line, where the line is representative of voltage versus local temperature. Configuring the response of the output signal, including configuring one or more output voltage values at one or more reference temperature points, results in an output response slope tailored to an application and/or an output signal slope that can be managed with the available supply range to the application.

In various implementations, at least a portion of the output response of the temperature sensor, as a function of output voltage versus temperature, may be translated (e.g., adjusted, shifted, or offset in a positive or negative direction while maintaining the overall slope of the response) and/or rotated/scaled (e.g., revolved about a fixed point such that the overall inclination or declination of the response is adjusted and/or stretched/compressed in one or more directions to change the pitch of the slope). In the implementations, the response (or a precursor current to the response) is translated (e.g., shifted) in the current domain, prior to the response being converted to a voltage signal.

In one implementation, an operational amplifier is arranged to extract a reference current and to output the response based on the reference current. For example, the reference current may comprise at least a portion of a PTAT-based current from a bandgap or base-emitter voltage-based current generator (e.g., a PTAT generator, or the like). In one implementation, the reference current is the result of balancing currents on a temperature constant node. For one example, the reference current is the result of subtracting a shifting current from a PTAT current, thus determining a slope for the voltage response.

Various implementations and techniques for configuring and/or adjusting the slope of the output response of a temperature sensor are discussed in this disclosure. Techniques and devices are discussed with reference to example devices, circuits, and systems illustrated in the figures that use CMOS transistors, or like components. However, this is not intended to be limiting, and is for ease of discussion and illustrative convenience. The use herein of the terms "transistor" or "bipolar device" are intended to apply to all of various bipolar junction-type components. For example, the techniques and devices discussed may be applied to any of various bipolar devices (including bipolar junction transistors, diodes, sub-threshold MOSFET devices, etc.), as well as various circuit designs, structures, systems, and the like, while remaining within the scope of the disclosure.

Implementations are explained in more detail below using a plurality of examples. Although various implementations and examples are discussed here and below, further implementations and examples may be possible by combining the features and elements of individual implementations and examples.

Example Environment

In various examples, a temperature sensor circuit may be constructed using low cost CMOS, Bi-CMOS, Bipolar/CMOS/DMOS (BCD) technologies, or the like. For example, the silicon temperature of the device (and thus the local temperature of the circuit material) may be sensed based on a forward diode voltage drop or on a base-emitter voltage of a bipolar transistor (BJT) biased in a designed collector current range. Based on these devices, or other similar devices, the most precise and least-expensive parameter to sense, that is proportional to the temperature of the silicon device, is the difference of the drop voltages (herein referred to as the "Proportional-To-Absolute-Temperature (PTAT) voltage, or $V_{PTAT}$") on two diodes or on two base-emitter transistors, biased with two currents having a constant ratio.

FIG. 1 illustrates two such example circuits 100 to obtain the $V_{PTAT}$ voltage, a first case with two diodes (D1 and D2) and a second case using two transistors (T1 and T2). In each case, the $V_{PTAT}$ is proportional with the temperature of the silicon region where the diodes (D1 and D2) or the BJT transistors (T1 and T2) are located. In the example circuits 100, the diodes or the transistors are placed close together to ensure a good thermal coupling. In the example circuits 100 depicted in FIGS. 1, A1 and A2 are the anode areas for the diodes (D1 and D2), or the emitter areas for the BJTs (T1 and T2). Further, in the circuits 100, the area A2 is greater than the area A1. The ratio of the bias currents for the diodes (D1 and D2) and the transistors (T1 and T2) is represented by the constant "N." In the examples, the value of N is greater-than or equal to 1.

Figure 2:
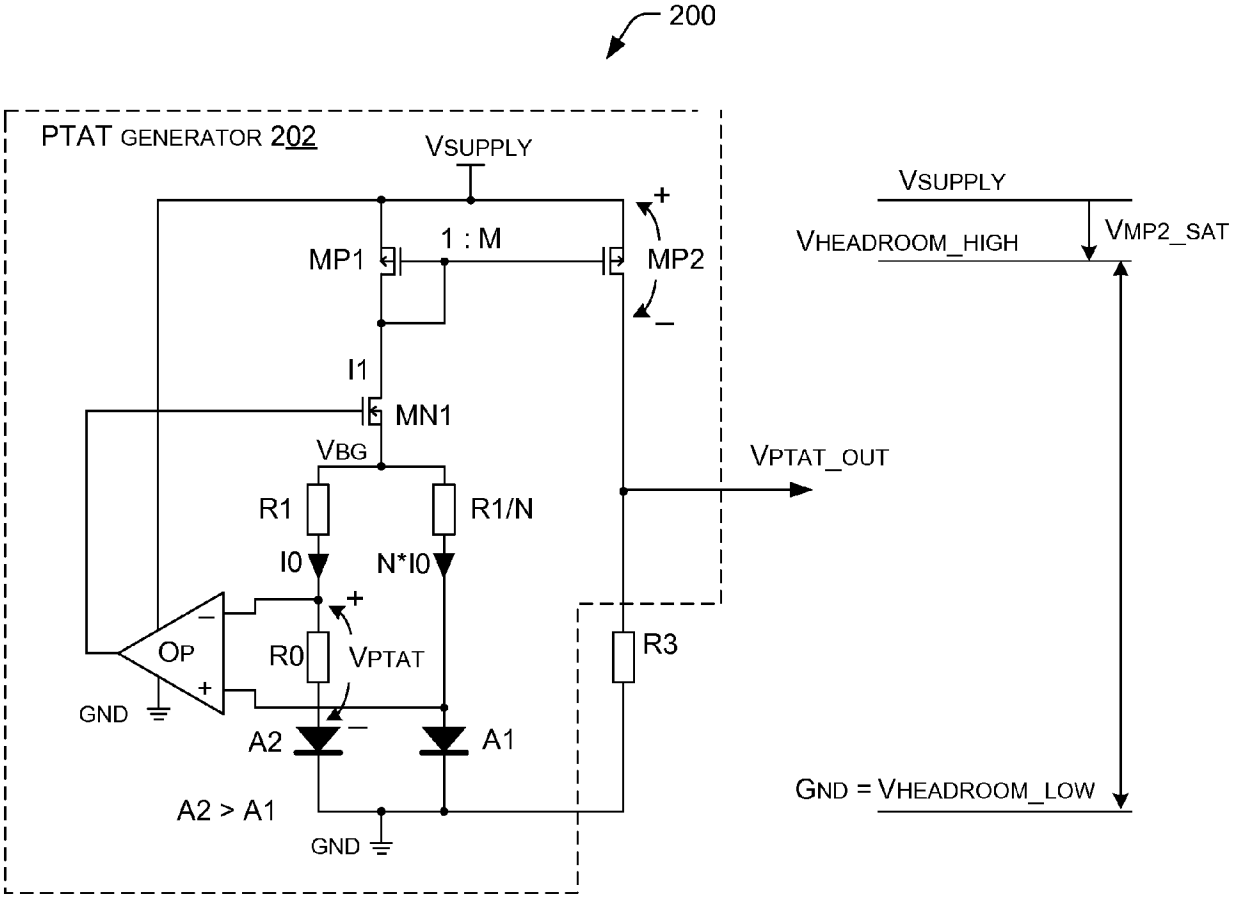
FIG. 2 is a schematic diagram of an example PTAT generator circuit, wherein the techniques and devices disclosed herein may be applied.

A temperature sensor circuit constructed using a PTAT voltage generator, such as one of the circuits 100, or the like, can be arranged to output a signal representative of the local temperature of the circuit material, based on the $V_{PTAT}$, since the $V_{PTAT}$ is proportional to the silicon temperature. Often, the output signal is a voltage signal Vptat_out, (otherwise referred to as $V_{TMON}$) as shown in FIG. 2. In various examples, the devices and techniques herein disclosed may be equally applied to various circuits providing a reference voltage, a reference current, a reference temperature, an over-temperature protection, or the like.

Figure 4:
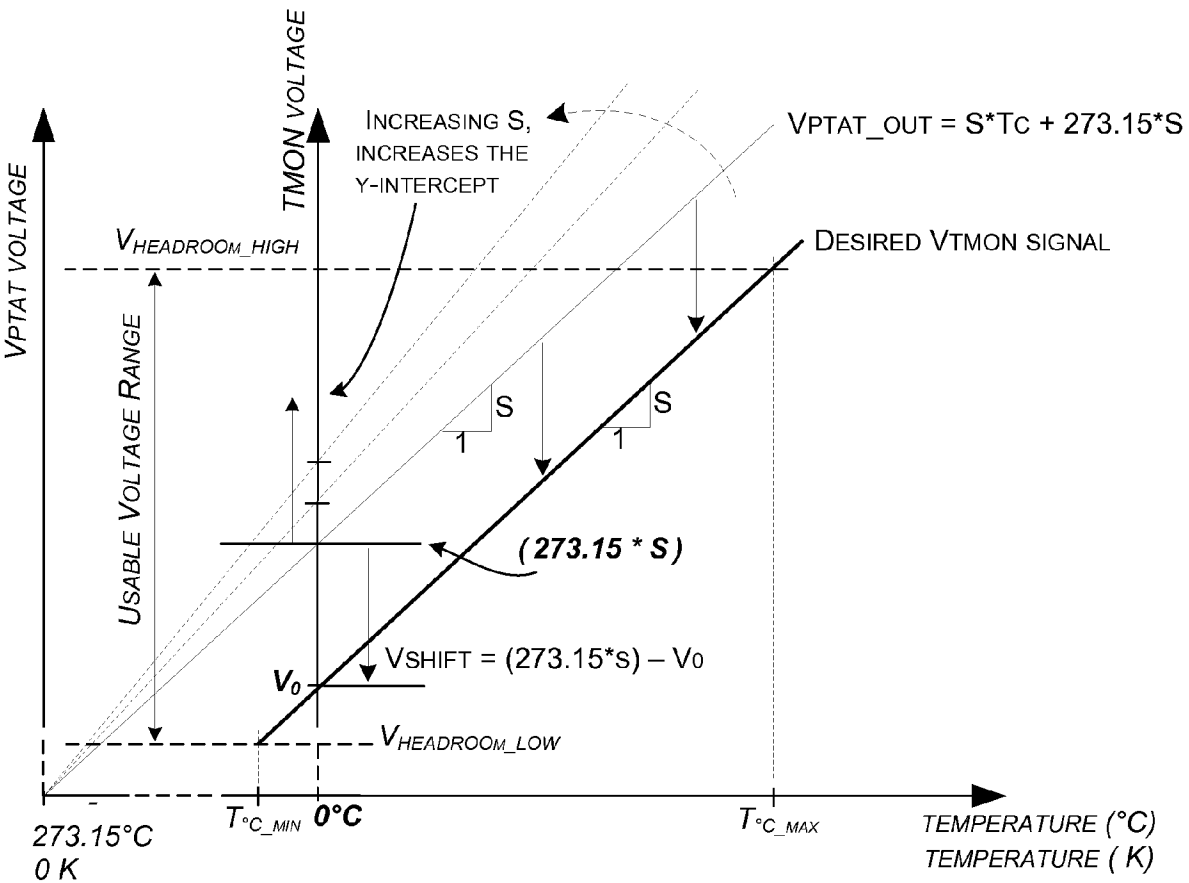
FIG. 4 is a graphical representation showing example shifting or translation of an output signal with respect to a usable voltage range.

In one desired application, for example, the output voltage signal, $V_{TMON}$, can be described with the following target formula:

$$V_{TMON}=S\cdot T_{\circ C.}+V_0 \qquad \text{Equation 1}$$

where $T_{\circ C.}$ is the measured temperature in degrees Celsius (° C.), $V_0$ is the $V_{TMON}$ output voltage at temperature $T_{0\circ C.}=0°$ C., and S (slope) is the gradient of the straight line $V_{TMON}$, also called the Temperature Coefficient (TC) on the output analog signal $V_{TMON}$. Relating equation 1 to the formula for a line, y=mx+b, $V_0$ is the constant term (or y-intercept) "b" and S is the slope "m" of the line that describes y as a function of x. This is illustrated in the graph of FIG. 4, where the output $V_{TMON}$ is a function of the temperature T(° C.) and has a slope of S, with a constant term (e.g., y-intercept) of $V_0$.

In an example, the PTAT voltage $V_{PTAT}$ may be described in terms of the temperature diode voltage dependency, as shown in the following formula:

$$Vptat=\frac{k*T_K}{q}*\ln\left(N*\frac{A_2}{A_1}\right)=\frac{k}{q}*\ln\left(N*\frac{A_2}{A_1}\right)*(T_{\circ C.}+273.15) \qquad \text{Equation 2}$$

where, q is the magnitude of the electron charge, k is the Boltzmann's constant, $T_K$ is the absolute temperature given in Kelvin and $T_{\circ C.}$ is the same temperature given in Celsius degrees.

Setting S as the multiplicative factor of the absolute temperature $T_K$:

$$S=\frac{k}{q}*\ln\left(N*\frac{A_2}{A_1}\right); \qquad \text{Equation 3}$$

and defining the absolute temperature $T_K$ in terms of temperature in Celsius degree, $T_{\circ C.}$, the PTAT voltage expression of Equation 2 can be rewritten with the formula:

$$Vptat=S*T_{\circ C.}+(273.15*S). \qquad \text{Equation 4}$$

Equation 4 partially realizes the target of Equation 1; however, in this formulation, the y-intercept $V_0$ is not independent from the slope S. In this form, the y-intercept $V_0$ is proportional to S through the constant value of 273.15. This proportional dependency can be problematic when it limits the usable range of the supply voltage.

For example, the basic circuits 100 of FIG. 1 used to create the voltage signal $V_{PTAT}$, have limited capability for determining a slope S value for a desired application. In one example, using Equation 3, considering that the term (k/q) is 86.2 μV/° C. and that the factor ($N*A_2/A_1$) is in the range of 10-1000, the practicable slope S values for the basic circuit 100 of FIG. 1 are 0.2-0.6 mV/° C. This range can be too limiting for some temperature sensor applications, for example.

Currently there are various circuits which may be employed to increase the value of S, such as the circuit 200 of FIG. 2. Many of these circuits are based on a "volt-ampere" method. This "volt-ampere" method consists of forming a PTAT generator 202 to convert the PTAT voltage, $V_{PTAT}$, created with a base circuit 100 of FIG. 1 (incorporated into the PTAT generator 202, for example) to an electrical current, I0. This current conversion may be realized through a resistor R0 across the $V_{PTAT}$ voltage. In such a realization, I0 comprises $V_{ptat}$/R0. Via additional devices, the current I0 can be magnified several times and then re-directed to another resistor, R3, for example, to convert the amplified current to the output voltage, $V_{PTAT_OUT}$.

In alternate implementations, as discussed further below, other possible circuit 200 designs (e.g., PTAT cells) for generating a PTAT current or a PTAT voltage can be used to output the $V_{PTAT_OUT}$ signal. In any case, using a circuit 200, the final output voltage, $V_{PTAT_OUT}$, can include the limitations of Equation 4. This is because the multiplication operations discussed with regard to the circuit 200 also occur with respect to the absolute temperature $T_K$, and not to the Celsius temperature $T_{\circ C.}$ alone. This can produce circuit design difficulties, as is discussed further below.

As shown in FIG. 2, the PTAT current "I0" is commonly used to generate the band-gap voltage $V_{BG}$ in the PTAT cell 200. For example, the $V_{BG}$ may be generated by supplying a serial connection of a resistance (R1/N, for example) and a diode (or BJT) (MN1, for example) within the PTAT current generator 202. FIG. 2 shows an example with the band-gap voltage $V_{BG}$ generated inside the cell 200 itself. The PTAT voltage drop on resistor R1/N (or R1 and R0 in the left leg) can be compensated with its complement produced by the base-emitter, or anode-cathode voltage. The band-gap voltage $V_{BG}$ is constant in temperature and can be used to generate a $V_{SHIFT}$ voltage for linear operation of the cell 200, as described below.

In various analog device applications, the supply voltage, $V_{SUPPLY}$, has a finite value often set to 3.3V or 5V. The internal analog voltage signals of the circuit 200 are elaborated in a well-defined range from a minimum value of $V_{HEADROOM_LOW}$, which could be 0V, to a maximum value of $V_{HEADROOM_HIGH}$, which could be $V_{SUPPLY}$. This means that all the internal voltage signals can move from $V_{HEADROOM_LOW}$, to $V_{HEADROOM_HIGH}$. In the best case the available voltage range for the internal circuits is equal to the supply voltage.

Figure 3:
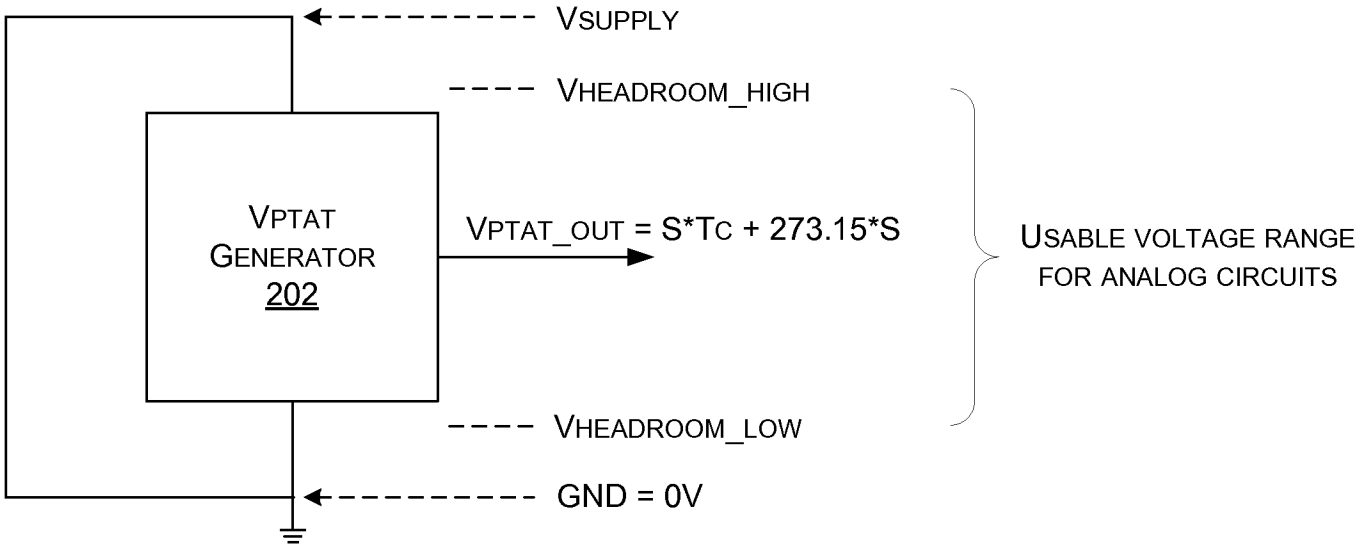
FIG. 3 is a block diagram illustrating an example usable voltage range for an analog circuit using a PTAT generator.

FIG. 3 describes the usable voltage range for the analog circuits in the PTAT cells of a circuit 200. As shown in FIGS. 2 and 3, the finite value of the supply voltage can limit the choice of a slope S, making inefficient use of the usable voltage range for the circuits. For example, a 16 mV/° C. slope output signal may have a signal voltage swing of only 3V but because of the multiplication factor shown in Equation 4 (e.g., V0=273.15*16 mV/° C.=4.37V), the $V_{PTAT_OUT}$ starts at over 4V, so it requires a supply voltage of over 7.2V, making poor usage of the supply range.

For example, if a thermometer to monitor the local temperature in the range between −20° to 180° centigrade is formed coinciding with a supply voltage of $V_{SUPPLY}$=3.3V, the maximum available slope S is 3.3/200=16.5 mV/° C. and the required y-intercept, V0, is −(16.5 mV/° C.*(−20° C.))=0.33V. In this example, the PTAT cells 200 deliver a PTAT voltage that follows Equation 4 with the y-intercept set at (S*273.15)=16.5 mV/° C.*273.15=4.51V. This value is too high to be processed by circuits powered at 3.3V.

With a supply voltage of 3.3V, analog circuits can manage only an S=4 mV/° C. case. A case with S=8 mV/° C. can be managed with a supply voltage of 3.61V. And a case of 16 mV/° C. requires at least 7.22V supply voltage (based on the best cases of negligible headroom voltages). Hence, the aforementioned techniques to generate a straight line voltage signal $V_{PTAT_OUT}$, prop ortional to the Celsius temperature $T_{\circ C.}$, through the slope S, are not flexible enough to optimize the use of the voltage supply range of the analog circuitries used to create the signal itself.

Example solutions for the issues regarding a limited slope S and limited usable voltage range may be discussed, while referring to FIG. 4. Based on the available voltage range for the analog circuitries 200, the $V_{PTAT_OUT}$ signal (which may include the final temperature monitor output signal $V_{TMON}$) used to monitor the internal temperature, has to be shifted downward in such a way as to keep the straight line inside the usable voltage range. In other words, there are functional limits downward, $V_{HEADROOM_LOW}$, and upward, $V_{HEADROOM_HIGH}$, (see FIGS. 2 and 3). This available interval is referred to as the "usable voltage range," and it is desired for the shifted straight line of the $V_{PTAT_OUT}$ signal to be inside this usable voltage range.

In some example solutions for shifting the $V_{PTAT_OUT}$ signal to within the usable voltage range, a circuit is formed using three circuit blocks, and the translation of the $V_{PTAT_OUT}$ signal is performed in the voltage domain. Two of the blocks comprise two PTAT cells, one to create a PTAT voltage signal, Vptat1, with an intermediate slope value, S1, in relation to the available supply, and a second one, as band-gap generator, to create the voltage shift signal. These two signals are elaborated linearly together with the third block, a differential amplifier, to obtain the final $V_{PTAT_OUT}$ or $V_{TMON}$ signal. However, these three blocks have to manage the signals, Vptat1, which is the output of the first block, $V_{BG}$, which is the output of the second block, and $V_{TMON}$, which is the output of the differential amplifier, within their usable voltage range. Consequently, it could be necessary to select an intermediate slope S1 that is less than the required slope S, for the Vptat1 signal, to allow optimal operation of the circuits.

However, this approach suffers from one or more limitations. For example, the approach uses three circuit blocks. In the PTAT cells 200, the y-intercept of the output is proportional to the slope S with the significant factor of 273.15 (Equation 4). This factor progressively increases the required supply headroom of the circuit as the temperature slope S increases. A dedicated reference voltage ($V_{BG}$) is needed to perform a voltage shift, so a second PTAT cell configured like a band-gap generator is used. Also, another circuit (the differential amplifier) is used to perform the shift of the y-intercept voltage to the required value, V0.

Additionally, using the approach described, the linear shifting operation depicted in FIG. 4 is made in the voltage domain, and externally to the PTAT and band-gap cells. In such an approach, the shifting operation can clash with the usable voltage range of the circuitries (one or more of the three blocks or additional sensor circuitry) involved in the operation.

Further, using CMOS technology (such as the example of FIG. 2), the PTAT current is generated from the ground line, so the generation of the first term of $V_{TMON}$, ($S*T_{\circ C.}$), requires a P-channel MOS current mirror to redirect this current from the supply to ground and to convert it in the voltage domain by a resistor (R3 in FIG. 2). This operation can introduce another source of error (such as MOS device mismatch, for example) in the final accuracy on the $V_{TMON}$ signal.

Example Current Domain Slope Configuration Circuit

Figure 5:
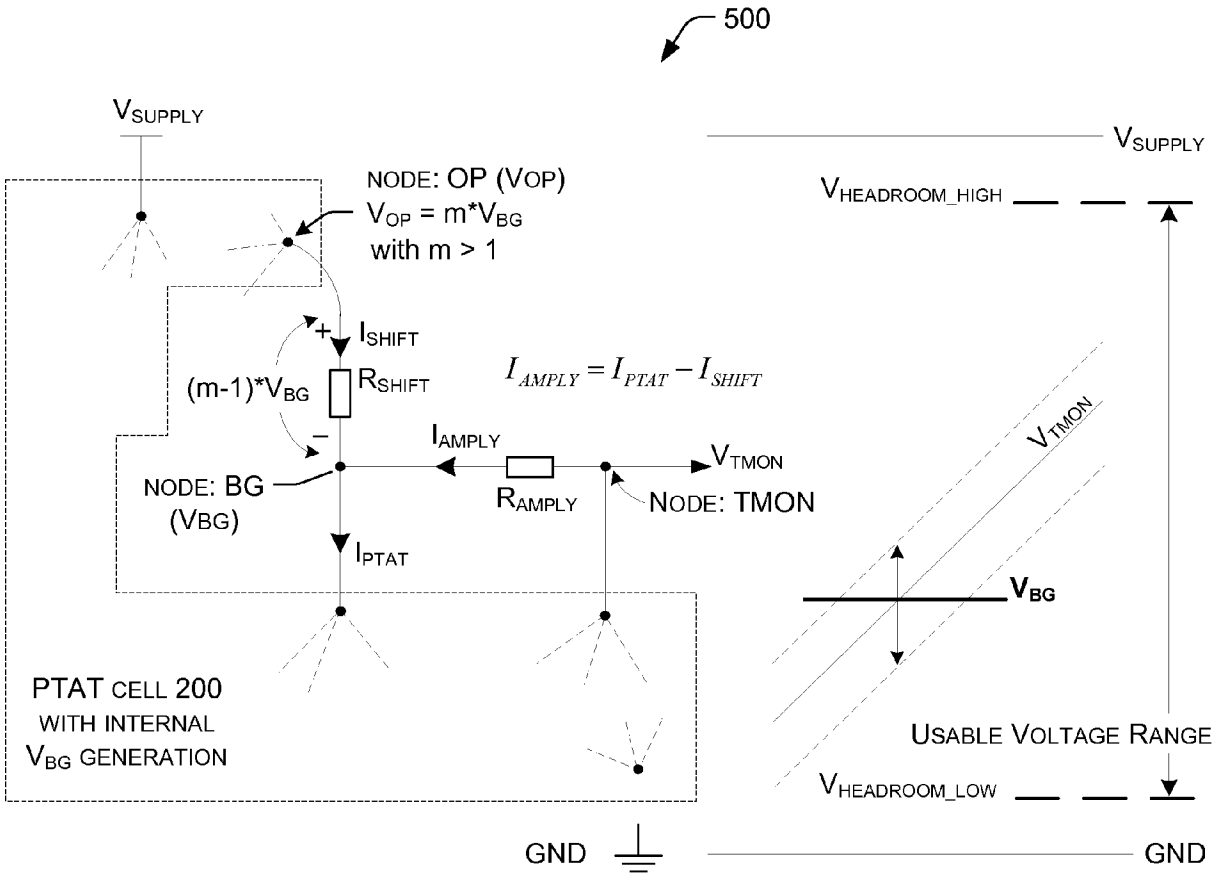
FIG. 5 is a schematic diagram of an example slope configuration circuit, according to an implementation.

Referring to FIG. 5, in an implementation, an example slope configuration circuit 500 may be formed using a PTAT generator 202 and/or a PTAT circuit 200 (e.g., PTAT cell), or the like. In the implementation, the PTAT cells 200 (FIG. 2 for example) are already delivering the signal of interest (the PTAT current I0 of FIG. 2) in the electric current domain (referred to as $I_{PTAT}$ in FIG. 5). In an implementation, instead of converting the PTAT current $I_{PTAT}$ to a voltage signal and then performing the shifting in the voltage domain, as described above, the current $I_{PTAT}$ remains in the electric current domain and the shifting operation includes a subtraction between electrical currents. Since $I_{PTAT}$ and the shifting signal $I_{SHIFT}$ are electrical currents, they are not penalized by the supply voltage swing limitation.

In an implementation, as shown in FIG. 5, the electrical currents ($I_{PTAT}$, $I_{SHIFT}$ and $I_{AMPLY}$) are balanced on a strategic node (i.e., the $V_{BG}$ node) to allow for the use of a resistor ($R_{AMPLY}$) to provide the amplification desired for the final slope S of the output signal $V_{TMON}$. In addition, the use of the $V_{BG}$ node provides a constant-voltage node in temperature, which moves the limitation of supply voltage to the output node, TMON, where the final voltage signal $V_{TMON}$ is created.

Figure 6:
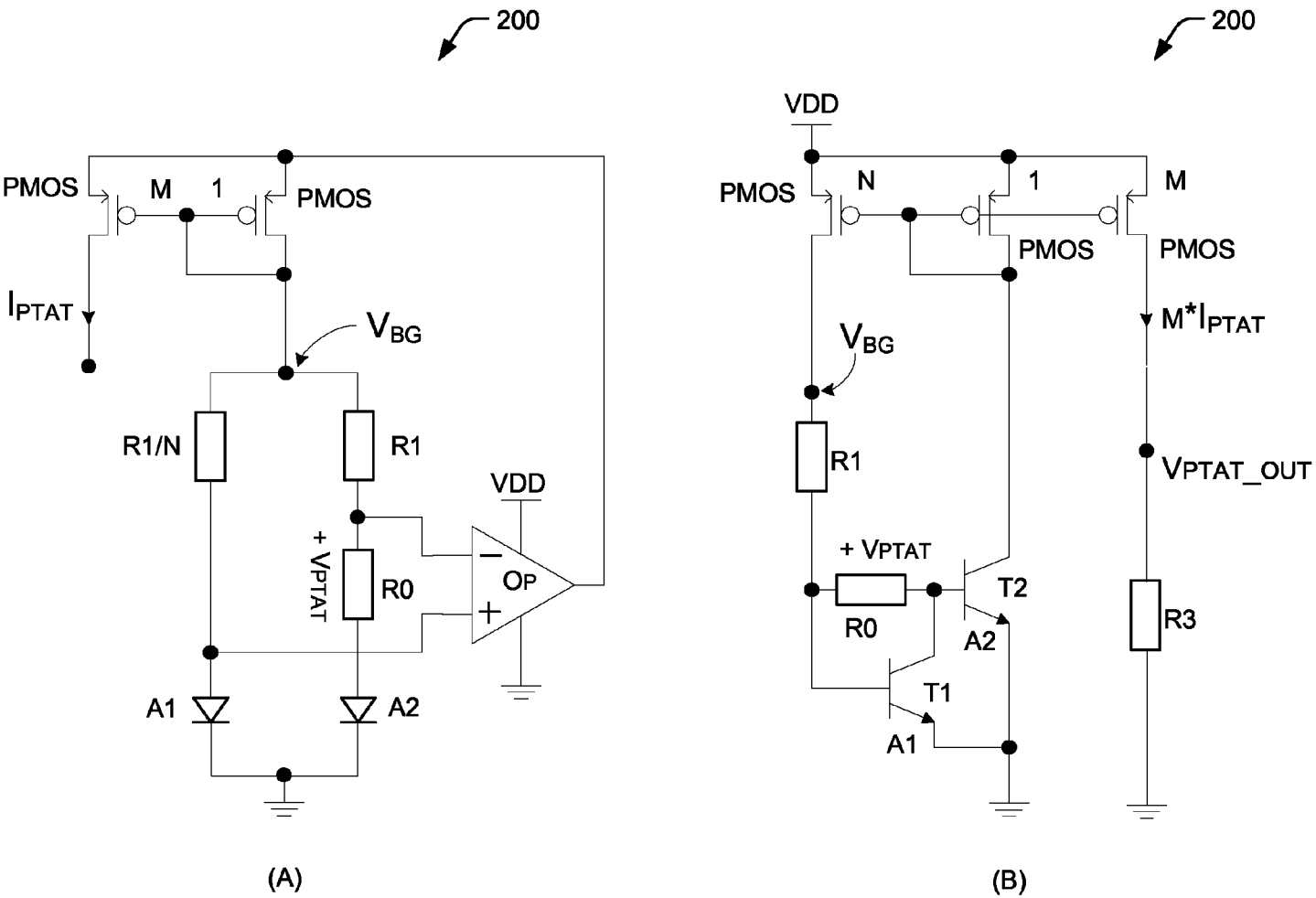
FIG. 6 shows two schematic diagrams of example PTAT generator circuits, wherein the techniques and devices disclosed herein may be applied, according to an implementation.

In various implementations, PTAT cells 200 that allow the generation of the band-gap voltage $V_{BG}$ internally, are used with the circuit 500 to form a configurable slope sensor cell, as described below. Two examples of such PTAT cells 200 are shown in FIG. 6. In alternate implementations, other arrangements and designs of PTAT cells 200 may also be used.

As shown in FIG. 5, the circuit 500 uses an internal operational node, OP, where an auxiliary voltage $V_{OP}$ is forced to have a value "m" times greater than the band-gap voltage $V_{BG}$. In the implementations, the parameter "m" is greater than unity. Also in the implementations, the $I_{PTAT}$ current generated by the cell 200 is present on the node BG, by construction. To achieve a current subtraction for the shifting operation, a resistor with value $R_{SHIFT}$ is coupled between the OP and BG nodes. The resulting current of the current balancing on node BG may be referred to as $I_{AMPLY}$ because it is the amplifying current used to obtain the final slope value S for $V_{TMON}$.

The described operation of balancing on node BG can be shown in the following manner:

$$I_{AMPLY} = I_{PTAT} - I_{SHIFT}; \quad \text{Equation 5}$$

$$I_{PTAT} = \frac{Vptat}{R0}; \quad \text{Equation 6}$$

$$I_{SHIFT} = (m-1) * \frac{V_{BG}}{R_{SHIFT}}, \text{ with } m > 1; \quad \text{Equation 7}$$

$$V_{TMON} = \frac{R_{AMPLY}}{R0} * Vptat - \left[(m-1) * \frac{R_{AMPLY}}{R_{SHIFT}} - 1\right] * V_{BG}. \quad \text{Equation 8}$$

Vptat, in Equation 8, may be given by Equation 2 for a specific cell 200 that has been chosen. The second, constant term in Equation 8, $$\left[(m-1) * \frac{R_{AMPLY}}{R_{SHIFT}} - 1\right],$$

can be used to compensate for the term (273.15*S) present in the Vptat mathematical expression of Equation 4.

In an implementation, the current subtraction (e.g., current balancing) of node BG of the current domain slope configuration circuit 500 shown in FIG. 5 and described by Equations 5-8 accomplishes the shift (e.g., translation) of the $V_{TMON}$ signal (e.g., $V_{PTAT_OUT}$ signal) to within the usable range of the supply voltage (i.e., between $V_{HEADROOM_HIGH}$ and $V_{HEADROOM_LOW}$). For instance, the technique includes using the electric currents (I0 and I1) already present in the PTAT cells 200 at the node BG, in conjunction with an auxiliary node OP, instead of working externally to the cells 200 with the voltage signals.

As illustrated by Equations 5-8, the resulting $V_{TMON}$ signal is based on the $I_{AMPLY}$ current (via resistance $R_{AMPLY}$), which is the difference between the $I_{PTAT}$ current (I0 in FIG. 2) and the $I_{SHIFT}$ current (a derivative of I1 of FIG. 2). The current $I_{AMPLY}$ changes value with changes to the current $I_{SHIFT}$, internal to the cell 200. Accordingly, the voltage signal $V_{TMON}$ changes proportionally to the current $I_{SHIFT}$. Thus, the current $I_{AMPLY}$ may be referred to as a reference current arranged to determine (via the resistance $R_{AMPLY}$) the output response $V_{TMON}$. The shifting operation is illustrated at the right portion of FIG. 5, where in implementations, the $I_{PTAT}-I_{SHIFT}$ internal operation moves (shifts) $V_{TMON}$ an amount that is proportional to $-I_{SHIFT}$.

Example Implementations

FIG. 6 shows two schematic diagrams (at (A) and (B)) of example PTAT cells 200 which generate the voltage $V_{BG}$ within the cell 200. The cells 200 of FIG. 6 may be used with the current shifting techniques and circuits described above (with respect to FIG. 5) to form a temperature sensor circuit, for example. Use of the cells 200 of FIG. 6 and the slope configuration circuit of FIG. 5 can result in an output signal response $V_{TMON}$ with a linear response that is within the usable voltage range of the circuitry, based on selecting desired values for the resistors, ratios, and semiconductor component areas for the sensor circuit. This is discussed in more detail below.

In an implementation, the PTAT cell 200 illustrated at FIG. 6(A) is an implementation of the cell 200 shown at FIG. 2. It is shown implemented with PMOS transistors having source areas with a ratio of M:1, where M is greater than or equal to unity.

In another implementation, the PTAT cell 200 illustrated at FIG. 6(B) is also shown implemented with PMOS transistors as well as BJTs, and includes novel design characteristics. For example, the collector of the transistor T1 is coupled to the base of the transistor T2. Also, the resistor R0, which develops the PTAT voltage $V_{PTAT}$, is coupled to the base of the transistor T2. Further, the emitters of T1 and T2 are coupled together. In alternate implementations, a cell 200 may include additional or alternate design characteristics.

Figure 7:
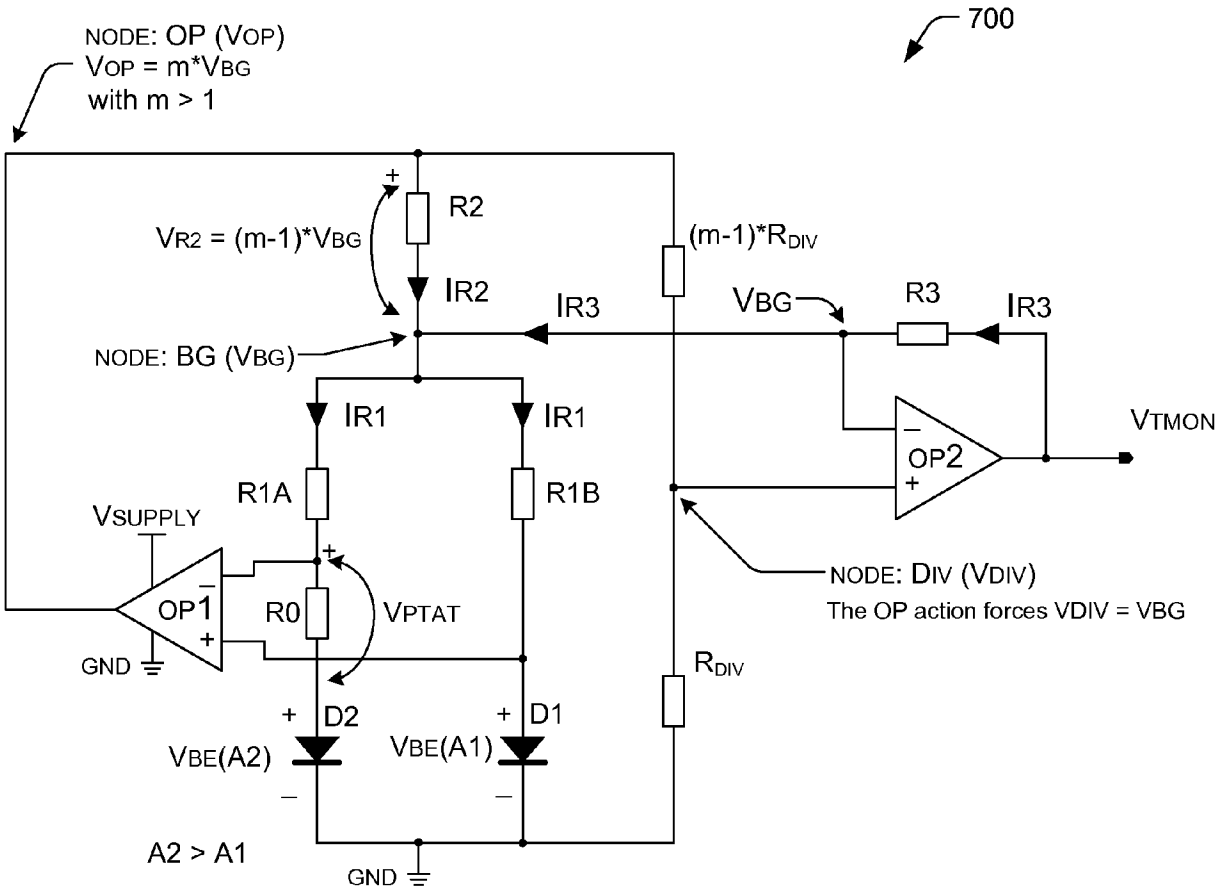
FIG. 7 is a schematic diagram of an example configurable slope temperature sensor cell circuit, having a configurable output slope, according to an implementation.

FIG. 7 is a schematic diagram of an example configurable slope temperature sensor cell ("sensor cell") 700, having a configurable output response (e.g., slope and/or constant) $V_{TMON}$, according to an implementation. In one implementation, the PTAT cell 200 illustrated at FIG. 6(A) is used with the current shifting techniques and circuits described above (with respect to FIG. 5) to form the sensor cell 700 of FIG. 7. In other words, the PTAT cell 200 of FIG. 6(A) is modified with techniques and components of the slope configuration circuit 500 to form the example sensor cell 700, and to produce the desired shifted output signal $V_{TMON}$. In various implementations, the cell 200 used with the circuit 700 may include various other configurations. In one example, the circuit 700 is implemented in a CMOS process.

In an implementation, as shown in FIG. 7, an operational amplifier OP2 is used to extract the shifted PTAT current IR3 from node BG and redirect it, toward the output $V_{TMON}$, through a resistor R3, for slope accommodation. In the implementation, the resistor R3 has the same function of $R_{AMPLY}$ discussed previously.

The two resistors R1A and R1B, the resistor R0, and the diodes D1 and D2 are set at preselected values to produce a constant voltage ($V_{BG}$), in temperature, on node BG. In various implementations, the value of R1A is equal to the value of R1B, resulting in the current $I_{R1}$ flowing through each of the two resistances. Since $V_{BG}$ is constant in temperature (i.e., the voltage at the node does not change with temperature, but remains constant over a broad temperature range encompassing at least the expected temperature range of the temperature sensor circuit 700), the voltage across the resistor R2 is also constant in temperature. As discussed above, the amplifier OP1 forces $V_{OP}$ to be "m" times greater than the $V_{BG}$ voltage, so $V_{R2}=(m-1)*V_{BG}$. Further, since $V_{BG}$ is constant in temperature, $V_{R2}$ is also constant in temperature, so that the PTAT current variation flowing into the two resistors R1A and R1B is forced to move on resistor R3, producing the desired PTAT voltage variation of $V_{TMON}$. Accordingly, $V_{TMON}$ is an accurate representation of the local temperature of the circuit material at the PTAT generator, and is shifted to be within a desired voltage range, based on the current shifting described above.

Figure 8:
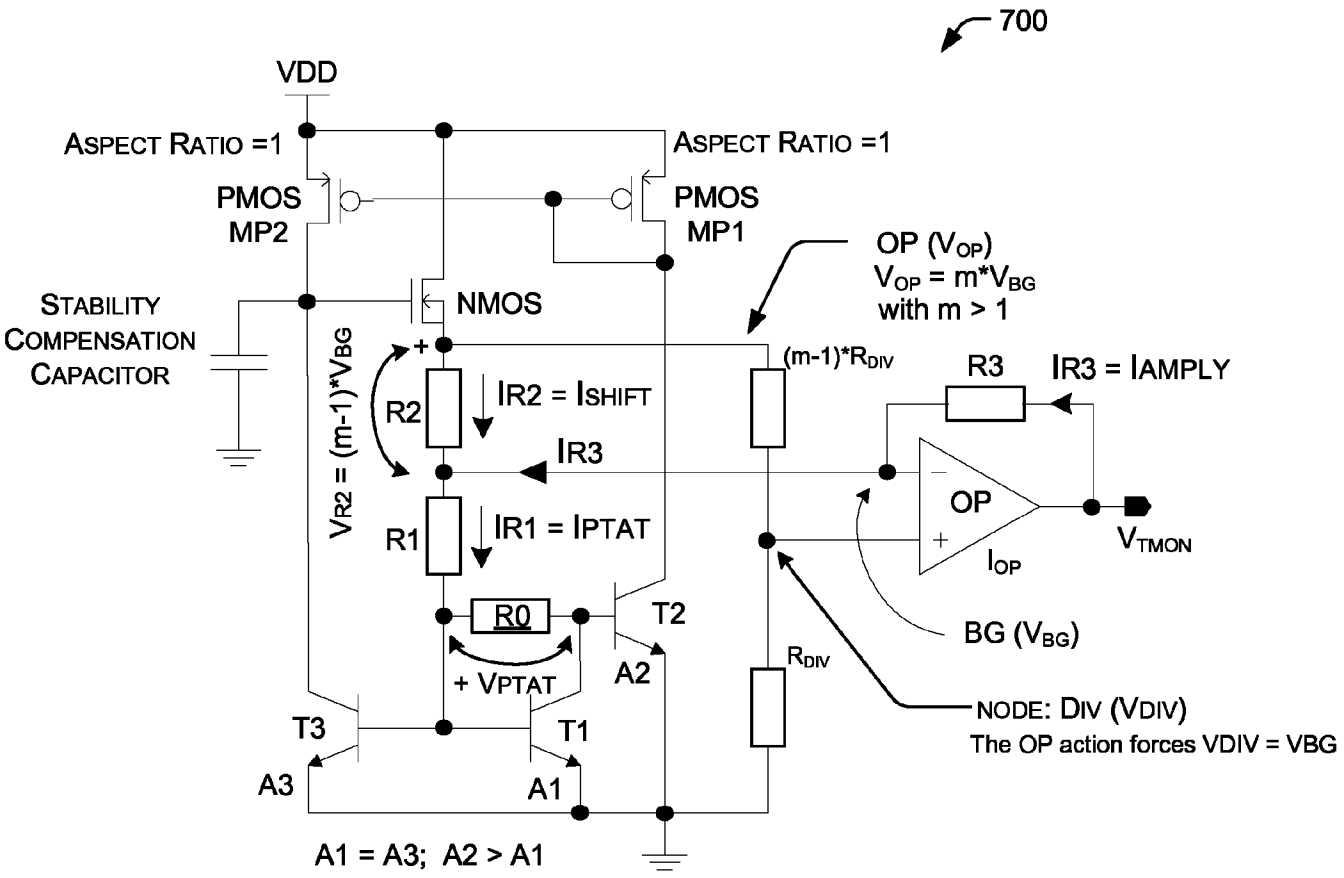
FIG. 8 is a schematic diagram of another example configurable slope temperature sensor cell circuit, having a configurable output slope, according to another implementation.

FIG. 8 also illustrates an example configurable slope temperature sensor cell ("sensor cell") 700, having a configurable output response (e.g., slope and/or constant) $V_{TMON}$, according to another implementation. In the implementation, the PTAT cell 200 illustrated at FIG. 6(B) is used with the current shifting techniques and circuits described above (with respect to FIG. 5) to form the sensor cell 700 of FIG. 8. In other words, the PTAT cell 200 of FIG. 6(B) is modified with techniques and components of the slope configuration circuit 500 to form the example sensor cell 700, and to produce the desired shifted output signal $V_{TMON}$. In various alternate implementations, the cell 200 used with the circuit 700 may also include various other configurations. In an example, as shown in FIG. 8, the circuit 700 is implemented by way of a BCD process. The circuit 700 may also be implemented by way of a Bi-CMOS process.

In an implementation, as shown in FIG. 8, an operational amplifier OP is used to extract the shifted PTAT current IR3 from node BG and redirect it, toward the output $V_{TMON}$, through a resistor R3, for slope accommodation. In the implementation, the resistor R3 has the same function of $R_{AMPLY}$ discussed previously.

The two resistors R1 and R2, the resistor R0, and the transistors T1 and T2 are set at preselected values to produce a constant voltage ($V_{BG}$), in temperature, on node BG. Since $V_{BG}$ is constant in temperature, the voltages across R2 are also constant in temperature, so that the PTAT current variations are forced to move on resistor R3, producing the desired PTAT voltage variation of $V_{TMON}$. Accordingly, $V_{TMON}$ is an accurate representation of the local temperature of the circuit 700 material at the PTAT generator, and is shifted to be within a desired voltage range, based on the current shifting described above.

For example, referring to FIGS. 7 and 8, the current IR3 that is flowing through resistor R3 (to form the output $V_{TMON}$) is based on the temperature-constant current generated by R2. In the implementation, resistor R2 has the same function of $R_{SHIFT}$ discussed previously. This produces a constant, versus temperature, voltage drop component on R3 that allows the constant term, $V_0$ of Equation 1, to be determined independently from the slope S.

An analytical circuit description can be shown directly from Equation 8, for example on FIG. 7 considering $R2=R_{SHIFT}$ and $R3=R_{AMPLY}$, and R1A=R1B.

$$V_{TMON} = \left\{2*\frac{k}{q}*\frac{R3}{R0}*\left[\ln\left(\frac{A_2}{A_1}\right)\right]\right\}*T_{°C.}+ \qquad \text{Equation 9}$$

-continued $$\left\{\begin{array}{c} 2*\frac{R3}{R0}*\frac{k*273.15}{q}*\left[\ln\left(\frac{A_2}{A_1}\right)\right]- \\ V_{BG}*\left[(m-1)*\frac{R3}{R2}-1\right] \end{array}\right\}$$

Equation 9 satisfies the target of Equation 1, when substituting:

$$S = 2*\frac{k}{q}*\frac{R3}{R0}*\ln\left(\frac{A_2}{A_1}\right); \text{ and} \qquad \text{Equation 10}$$

$$V_0 = \left\{\begin{array}{c} 2*\frac{R3}{R0}*\frac{273.15*k}{q}*\left[\ln\left(\frac{A_2}{A_1}\right)\right]- \\ V_{BG}*\left[(m-1)*\frac{R3}{R2}-1\right] \end{array}\right\} \qquad \text{Equation 11}$$

In these relationships, the parameters m, $A_1$, $A_2$, R0, R2 and R3 are free to be selected to reach the desired values for S and $V_0$ in Equation 1. In other words, a desired slope S and a desired y-intercept V0 (for a particular temperature sensor application, for instance) may be chosen for the output response of $V_{TMON}$, based on selecting one or more of the parameters m, $A_1$, $A_2$, R0, R1, R2 and R3. In that way, an output response $V_{TMON}$ of the sensor circuits 700 may be configured (for slope S and y-intercept V0) based on the desired application.

In the implementations illustrated in FIGS. 7 and 8, the slope's magnification (S) and the voltage translation to $V_0$ are operations embedded in the PTAT generator 200. This is due to the current balancing on node BG, instead of using techniques that use external voltage substraction with Vptat and $V_{BG}$. For example, as shown in FIG. 7 (and similarly for FIG. 8):

$$\begin{aligned} I_{R3} &= 2*I_{R1}-I_{R2} = 2*Vptat/R0-V_{BG}/R2; \\ V_{TMON} &= R3*I_{R3}+V_{BG}, \text{ and} \\ V_{TMON} &= 2*\frac{R3}{R0}*Vptat+\left(1-\frac{R3}{R2}\right)*V_{BG}. \end{aligned} \qquad \text{Equation 12}$$

Figure 9:
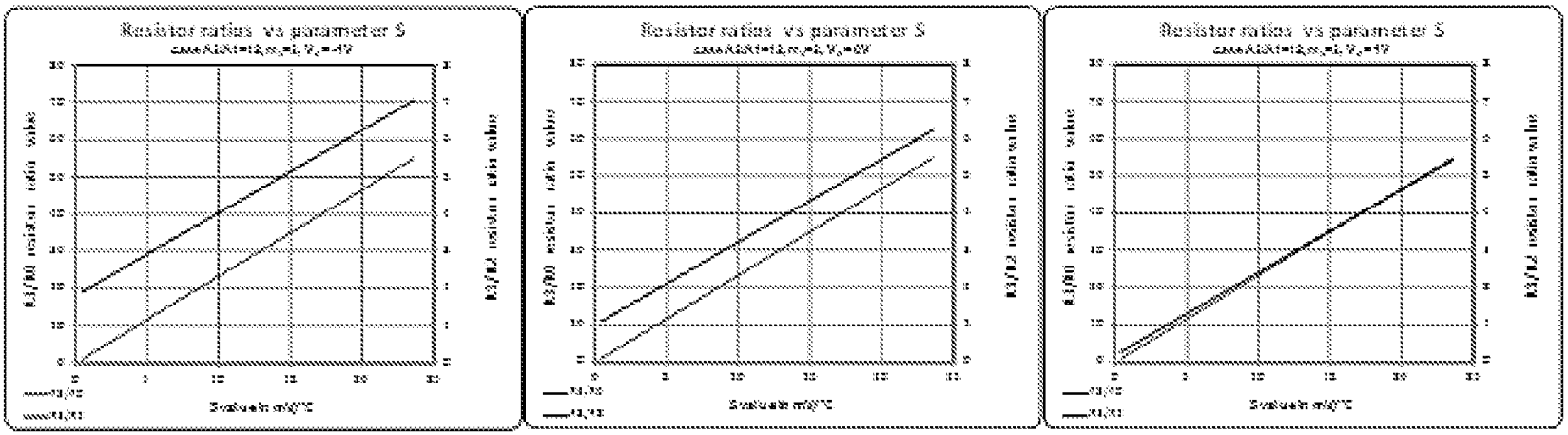
FIG. 9 is a series of graphs illustrating slope configuration results of a temperature sensor circuit, based on selected component values, according to various examples.

FIG. 9 is a series of three graphs illustrating slope configuration results of a configurable slope temperature sensor cell 700, based on selected component values (e.g., one or more of parameters m, $A_1$, $A_2$, R0, R1, R2 and R3), according to various examples. For example, the slope S is shown in the graphs for different resistor ratios chosen for R3/R0 and R3/R2 with $V_0$ at −1V, 0V, +1V cases. For instance, the graphs of FIG. 9 illustrate the response $V_{TMON}$ of a circuit 700 having the parameters of (A2/A1)=12, m0=2 and V0=0. For each graph, the resistor ratios (R3/R0) and (R3/R2) are strategically selected for a specified choice of parameter S. As shown in the graphs of FIG. 9, the selection of resistor ratios has the effect of configuring the response $V_{TMON}$ so that it is closer to a desired profile.

In various implementations, since the term (2*k/q) has the value of 172.4 μV/° C. and the term [ln(A2/A1)] can be chosen in the range of 2-3, the parameter S can reach the value of 20 mV/° C. or higher.

In the implementations, the parameter S can be set through the (R3/R0) and ($A_2/A_1$) ratios, independently from the $V_0$ value, because $V_0$ can be adjusted by (R3/R2) and (m) values separately. The slope (i.e., Temperature Coefficient) "S", as shown in Equation 10, is related only to the physical constant (k/q) and the geometrical area ratios (R3/R0), so it is independent from process spreads. In various examples, the global final performance on S is determined by the quality of the operational amplifiers OP1 and OP2 (offsets and gains, for example) and the resistors matching. On another hand, the spread of the constant term, $V_0$, having the band-gap voltage ($V_{BG}$) in its expression, can suffer (±5% over ±6σ), and a trimming of its value through the variation of the value of "m" may be desired.

Additional Implementations

In various implementations, the constant voltage term, $V_0$, as shown in equation 11 and output as part of $V_{TMON}$ by the sensor cell circuits 700 can be tuned to the desired value by changing the ratio "m" of the resistor divider (e.g., resistance (m−1) and resistance 1) connected between the node OP and ground, as illustrated in FIG. 7. In an implementation, this is realized with an R−2R resistor ladder network as shown in FIG. 10.

Figure 10:
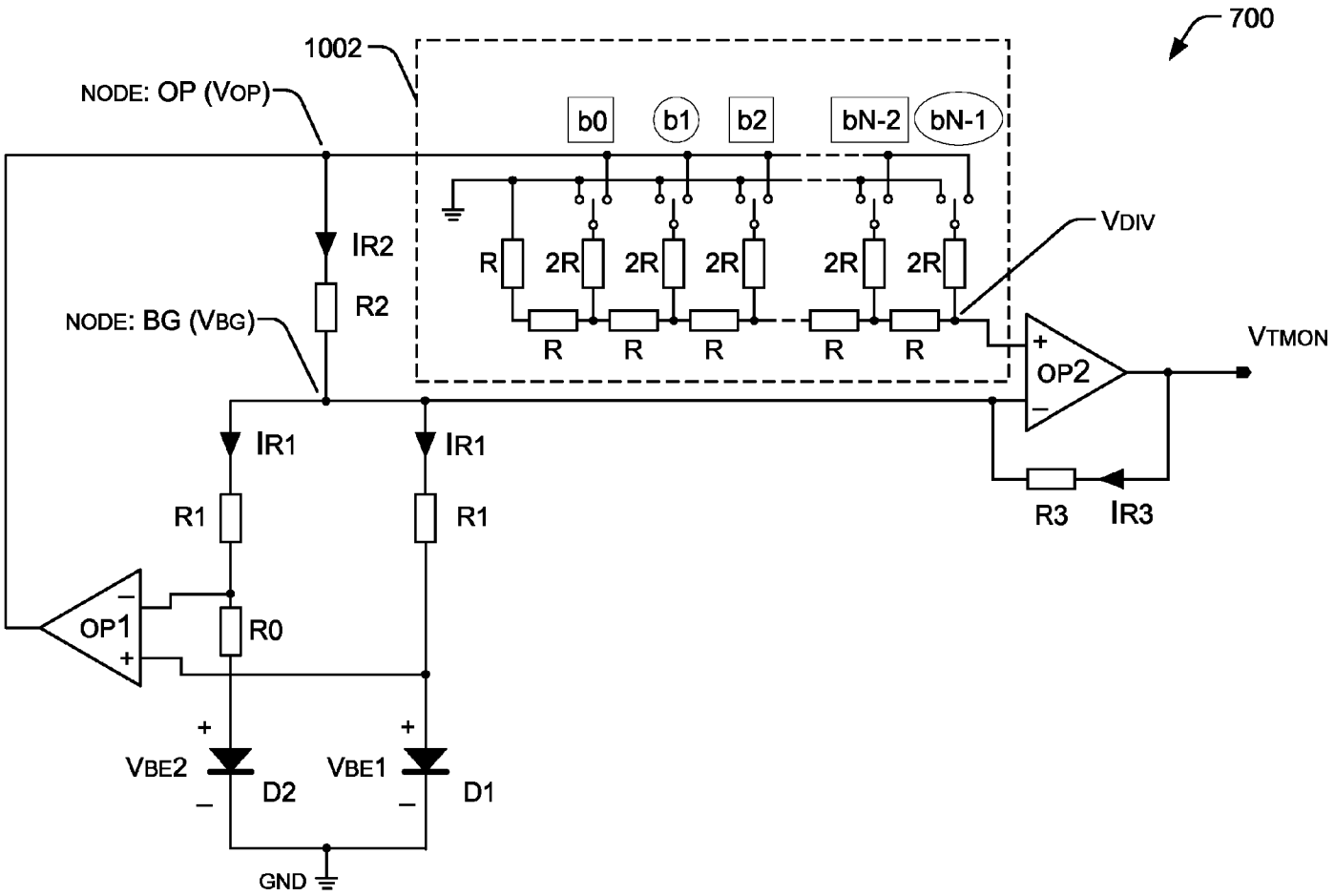
FIG. 10 is a schematic diagram of an example temperature sensor circuit, having a configurable output slope and resistor ladder network, according to an implementation.

In an example, as shown in FIG. 10, a circuit 700 uses a resistor ladder 1002 to fine tune the preselected initialization value $V_0$. In the example, the bits "bn−1," which is the most significant bit (MSB) through "b0", which is the least significant bit (LSB), are driven from digital logic gates or another type of controller (e.g., via a "digital word," or the like) ideally represented with N switches. In the example, the bits are switched between 0 volts (logic 0) and $V_{OP}$ (logic 1). In alternate implementations, other methods may be used to implement the logic control of the bits.

Considering the example, where the value, VAL includes the digital value of a generic quantity of "N" bits in combination, VAL can be expressed as:

$$VAL=2^{N-1}b_{N-1}+2^{N-2}b_{N-2}+\ldots+2^0b_0, \quad \text{Equation 13}$$

then, voltage the $V_{DIV}$ is expressed as:

$$V_{DIV}=V_{OP}*\frac{VAL}{2^N}, \quad \text{Equation 14}$$

so, the parameter "m" is given as:

$$m=\frac{V_{OP}}{V_{DIV}}=\frac{2^N}{VAL}. \quad \text{Equation 15}$$

In an implementation, the parameter "m" may be reduced to a minimal interval around the value m0, by trimming to recover the variation spread of $V_{BG}$ and the offset of the operational amplifiers (OP1 and OP2). It can be shown that the operational amplifier offsets act only on the second term of equation 1 (as shown in the expression of equation 11), so if the op-amps (OP1, OP2) offsets are quite stable in temperature, the op-amps (OP1, OP2) do not affect the temperature coefficient "S" (as shown in the expression of equation 10). Offset-compensated op-amps (OP1, OP2) can promote the independence of the op-amps (OP1, OP2) and the temperature coefficient S.

In the implementation, the parameter "m" may be trimmed to compensate for its variation around its default value "m0" by splitting the VAL value in equation 13 in two terms, $VAL_0$ and ΔVAL, where $VAL=VAL_0+\Delta VAL$. This is shown as implemented using the R−2R resistor ladder 1002 of FIG. 10. For example, the bits b0, b2, and bN−2 represent variable bits for trimming (ΔVAL). The bits b1 and bN−1 represent fixed bits for determining the constant "m0" ($VAL_0$). In an example, the bandgap natural spread of ±5% (±6σ) uses a small accommodation of the parameter "m," making its behavior quite linear versus "ΔVAL." The circuit 700 may be implemented similarly with sub-threshold MOS devices using $V_{GS}$ instead of $V_{BE}$ and $\Delta V_{GS}$ instead of $\Delta V_{BE}$, for example.

The techniques, components, and devices described herein with respect to the example arrangement 500 and/or the circuit 700 are not limited to the illustrations of FIGS. 1-11, and may be applied to other circuits, structures, devices, and designs without departing from the scope of the disclosure. In some cases, additional or alternative components may be used to implement the techniques described herein. Further, the components may be arranged and/or combined in various combinations, while remaining within the scope of the disclosure. It is to be understood that a circuit 700 with an arrangement 500, or the like, may be implemented as a standalone device or as part of another system (e.g., integrated with other components, systems, etc.).

Figure 11:
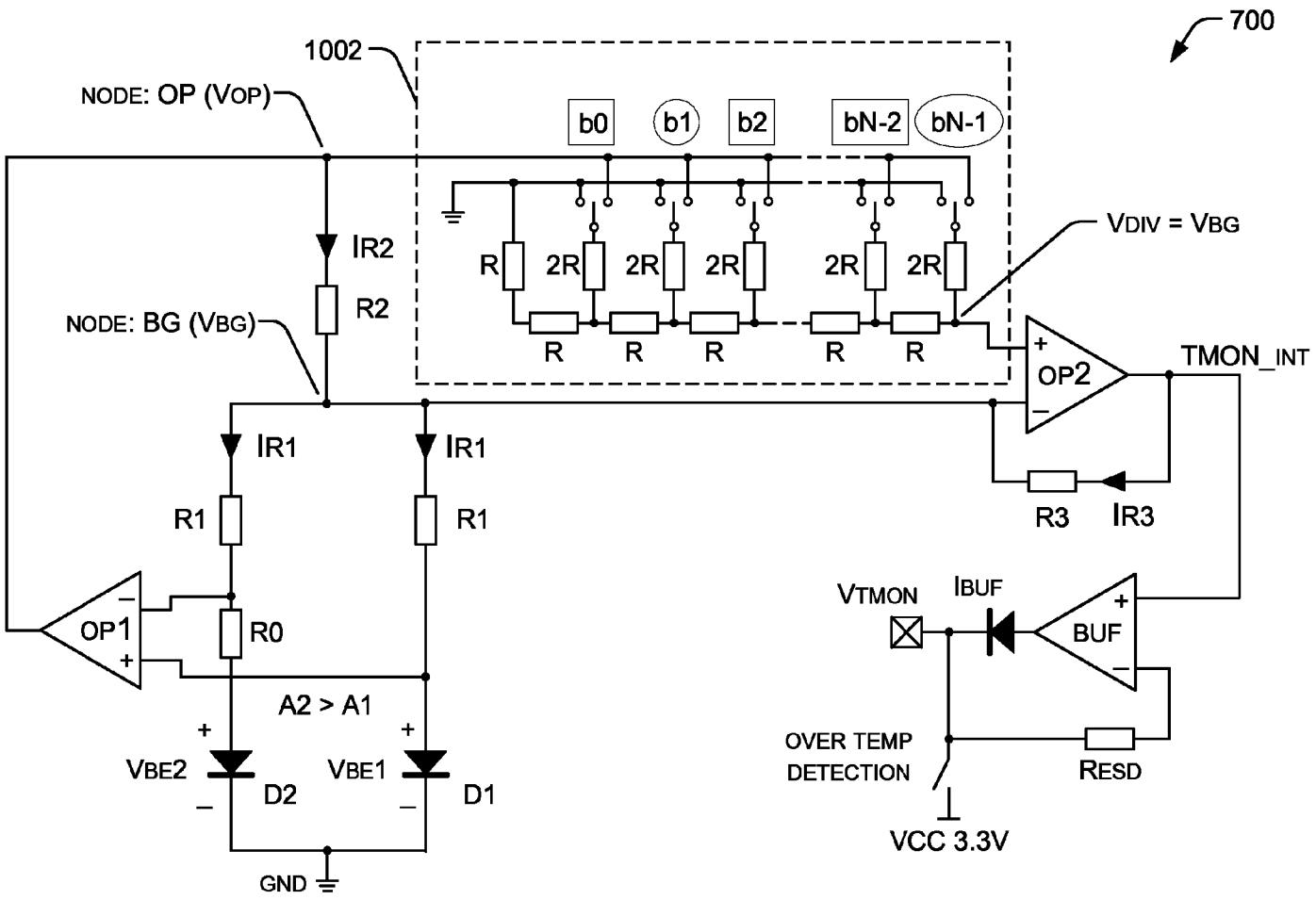
FIG. 11 is a schematic diagram of another example temperature sensor circuit, having a configurable output slope and resistor ladder network, according to an implementation.

FIG. 11 is a schematic diagram of another example temperature sensor circuit 700, having a configurable output slope and resistor ladder network, according to an implementation. For example, FIG. 11 illustrates the circuit of FIG. 10, as realized in silicon 0.4 μm HVCMOS process.

In an implementation, as shown in FIG. 11, a buffer block is added at the output of the circuit 700 to create other functions used by peripheral circuits or devices. In an example, the amplifier OP1 is a three stages low drop-out operational amplifier not offset-compensated. In another example, OP2 and BUF are two stages not offset-compensated operational amplifiers.

Representative Process

Figure 12:
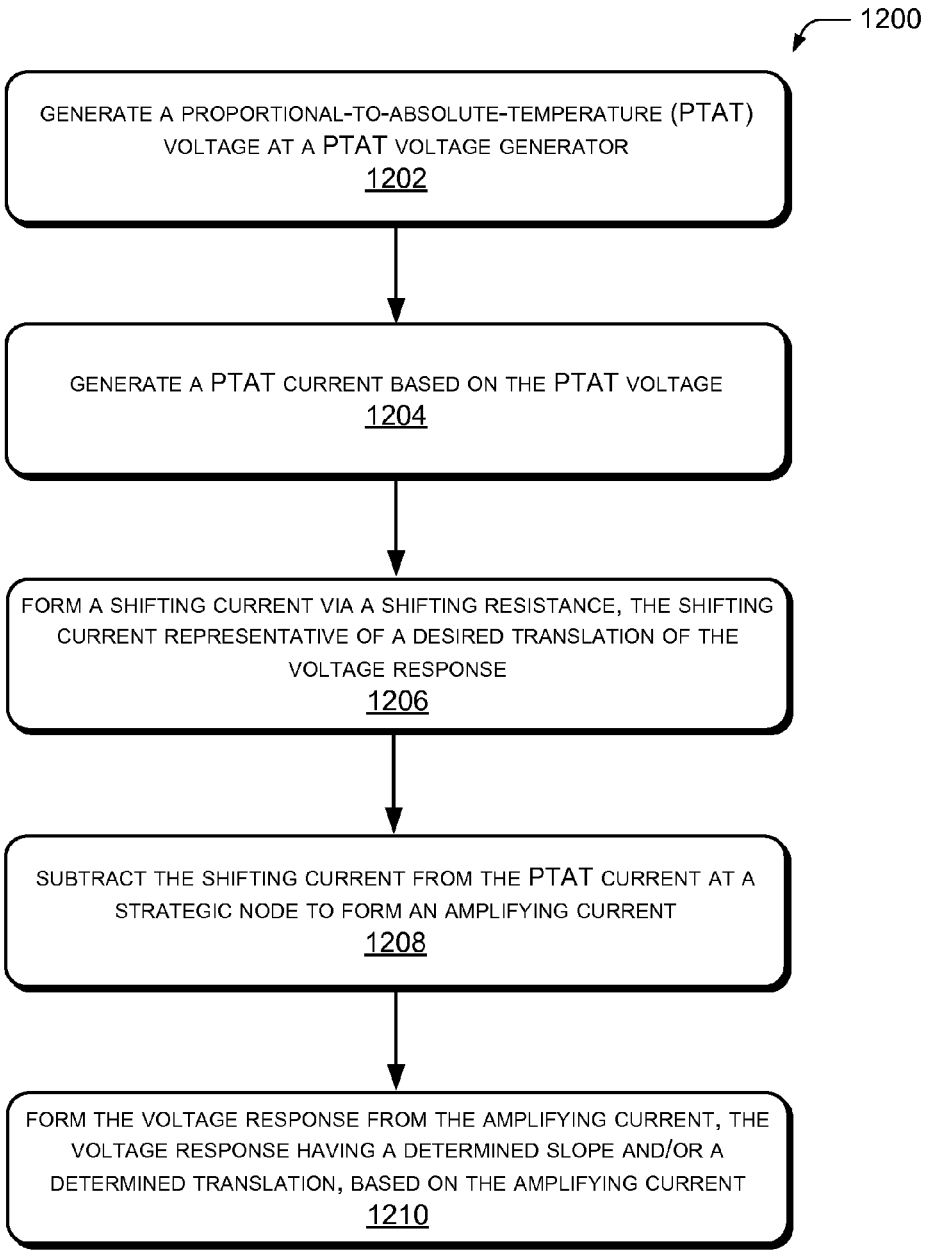
FIG. 12 is a flow diagram illustrating an example process for configuring an output slope of a PTAT-based temperature sensor, according to an implementation.

FIG. 12 is a flow diagram illustrating an example process 1200 for configuring a slope of a bandgap or base-emitter voltage-based temperature sensor (such as temperature sensor 700, for example), according to an implementation. The process 1200 describes extracting a reference current from a current generator, the reference current based on a PTAT current, and forming a voltage response having a desired slope and initialization point. In an implementation, the voltage response is representative of the local temperature of the circuit material (e.g., silicon, etc.) where the PTAT current is generated, and either or both of the slope and initialization point may be configured, based on current shifting in the current domain. The process 1200 is described with reference to FIGS. 1-11.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 1202, the process includes generating a proportional-to-absolute-temperature (PTAT) voltage at a PTAT voltage generator. At block 1204, the process includes generating a PTAT current based on the PTAT voltage. For example, in an implementation, the process includes extracting a proportional-to-absolute-temperature (PTAT) current from a bandgap voltage-based PTAT current generator.

At block 1206, the process includes forming a shifting current via a shifting resistance, where the shifting current is representative of a desired translation of the voltage response. For example, in an implementation, the process includes forming the shifting current via an auxiliary voltage node having a voltage greater than a band-gap voltage of the PTAT generator. In the implementation, the shifting resistance is disposed between a strategic node and the auxiliary voltage node. In an example, the strategic node is the band-gap voltage node. In a further implementation, the band-gap voltage node is interior to the PTAT generator.

At block 1208, the process includes subtracting the shifting current from the PTAT current at the strategic node to form an amplifying current. In an implementation, the process includes forming the amplifying current by balancing the shifting current and the PTAT current at the strategic node. In the implementation, the strategic node has a constant voltage in temperature.

In an implementation, the process includes extracting the amplifying current from the band-gap voltage-based or base-emitter voltage-based PTAT current generator via an operational amplifier.

At block 1210, the process includes forming the voltage response from the amplifying current, the voltage response having a determined slope and/or a determined translation, based on the amplifying current. In an implementation, the process includes determining the slope and/or the translation of the voltage response in the current domain, prior to or concurrent with forming the voltage response.

In an implementation, the process includes selecting a value for an amplifying resistance and forming a desired slope of the voltage response via the amplifying resistance. For example, the amplifying current flows through the amplifying resistance to form the voltage response. In an implementation, the process includes strategically selecting at least one of the set comprising: a quantity of resistance magnitudes, one or more resistance ratios, two or more bipolar device emitter areas, and one or more bipolar device emitter area ratios, and determining the slope and/or the translation of the voltage response based on the selection.

In an implementation, the process includes configuring or adjusting the voltage response in the current domain to fit within a voltage profile without limiting the adjusting in the current domain to a voltage supply range. In a further implementation, the process includes configuring or adjusting the voltage response to fit within a specified power supply range.

In an implementation, the process includes outputting the voltage response with the determined slope and/or the determined translation. In the implementation, the voltage response is representative of a local circuit material temperature where the PTAT generator is located. In an implementation, the voltage response is a profile of voltage versus temperature, and at least a portion of the response is substantially linear.

In alternate implementations, other techniques may be included in the process in various combinations, and remain within the scope of the disclosure.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing example devices and techniques.

What is claimed is:

1. An apparatus, comprising:

a proportional-to-absolute-temperature (PTAT) current generator coupled to a strategic node and arranged to generate a PTAT current;

a shifting resistance coupled to the strategic node and arranged to pass a shifting current, the shifting current representative of a desired translation of a voltage response; and an amplifying resistance coupled to the strategic node and arranged to pass an amplifying current comprising the shifting current subtracted from the PTAT current, the amplifying resistance forming the voltage response via the amplifying current, the voltage response having a determined slope and/or a determined translation, based on the amplifying current.

2. The apparatus of claim 1, further comprising an operational amplifier arranged to extract the amplifying current and to output the voltage response, the voltage response representative of a local temperature of a circuit material where the PTAT generator is located.

3. The apparatus of claim 2, further comprising another operational amplifier or a control loop configured to force an auxiliary node to maintain a voltage greater than a band-gap voltage of the PTAT current generator, the shifting resistance disposed between the strategic node and the auxiliary node.

4. The apparatus of claim 1, further comprising an auxiliary node having an auxilliary voltage that is constant in temperature, the shifting resistance disposed between the strategic node and the auxiliary node, the auxiliary node forced to maintain a voltage value greater than a voltage value at the strategic node.

5. The apparatus of claim 1, wherein the amplifying resistance is disposed between the strategic node and an output node of the apparatus.

6. The apparatus of claim 1, wherein the strategic node comprises a band-gap voltage node, the strategic node having a constant voltage in temperature.

7. The apparatus of claim 1, wherein the apparatus is configured to determine the slope and/or the translation of the voltage response based on current subtraction in the current domain.

8. An electrical circuit, comprising:

a band-gap voltage-based circuit portion arranged to provide a first current based on a base-emitter voltage of one or more bipolar devices; and a slope configuration portion arranged to determine a slope and/or a translation for an output voltage response representative of a local temperature of a material of the circuit, the slope configuration portion including:

a strategic node coupled to the band-gap voltage-based circuit portion, and having a voltage that is constant in temperature;

a shifting resistance coupled to the strategic node and arranged to pass a shifting current representative of a desired slope and/or translation of the voltage response; and an amplifying resistance coupled to the strategic node and arranged to pass an amplifying current comprising the shifting current subtracted from the first current, the amplifying resistance forming the voltage response via the amplifying current, the voltage response having the desired slope and/or translation, based on the amplifying current.

9. The electrical circuit of claim 8, further comprising a resistor ladder network arranged to fine tune the voltage response with respect to the desired slope and/or translation.

10. The electrical circuit of claim 9, wherein the resistor ladder network comprises a series of logical bits switchably coupled to a voltage source and arranged to output a variable voltage value representative of a digital word.

11. The electrical circuit of claim 10, wherein one or more of the logical bits represent variable bits and one or more others of the logical bits represent fixed bits, the combination of variable bits and fixed bits outputting the variable voltage value.

12. The electrical circuit of claim 8, wherein the slope configuration portion is arranged to shift and/or to rotate/scale the voltage response to fit within a specified power supply range via current subtraction in the current domain.

13. The electrical circuit of claim 8, wherein the slope configuration portion is arranged to adjust the slope and/or the translation of the output voltage response via selection of one or more resistance ratios and/or one or more bipolar device emitter area ratios.

14. The electrical circuit of claim 8, wherein the band-gap voltage-based circuit portion comprises a proportional-to-absolute-temperature (PTAT) voltage generator or a PTAT current generator.

15. The electrical circuit of claim 14, wherein the band-gap voltage-based circuit portion comprises a pair of transistors with emitters coupled together, a collector of one of the transistors coupled to a base of the other transistor, and wherein a PTAT voltage based on base-emitter voltages of the pair of transistors is formed across a resistance coupled to the base of the other transistor, and the first current is formed from the PTAT voltage.

16. A method of configuring a voltage response, comprising:

generating a proportional-to-absolute-temperature (PTAT) voltage at a PTAT voltage generator;

generating a PTAT current based on the PTAT voltage;

forming a shifting current via a shifting resistance, the shifting current representative of a desired translation of the voltage response;

subtracting the shifting current from the PTAT current at a strategic node to form an amplifying current; and forming the voltage response from the amplifying current, the voltage response having a determined slope and/or a determined translation, based on the amplifying current.

17. The method of claim 16, further comprising forming the amplifying current by balancing the shifting current and the PTAT current at the strategic node, the strategic node having a constant voltage in temperature.

18. The method of claim 16, further comprising determining the slope and/or the translation of the voltage response in the current domain, prior to or concurrent with forming the voltage response.

19. The method of claim 16, further comprising selecting a value for an amplifying resistance and forming a desired slope of the voltage response via the amplifying resistance, the amplifying current flowing through the amplifying resistance to form the voltage response.

20. The method of claim 16, further comprising forming the shifting current via an auxiliary voltage node having a voltage greater than a band-gap voltage of the PTAT generator, the shifting resistance disposed between the strategic node and the auxiliary voltage node.

21. The method of claim 16, further comprising extracting the amplifying current from a bandgap voltage-based or base-emitter voltage-based PTAT current generator via an operational amplifier.

22. The method of claim 16, further comprising strategically selecting at least one of the set comprising: a quantity of resistance magnitudes, one or more resistance ratios, two or more bipolar device emitter areas, and one or more bipolar device emitter area ratios, and determining the slope and/or the translation of the voltage response based on the selection.

23. The method of claim 16, further comprising configuring or adjusting the voltage response in the current domain to fit within a voltage profile without limiting the adjusting in the current domain to a voltage supply range.

24. The method of claim 16, further comprising outputting the voltage response with the determined slope and/or the determined translation.

25. The method of claim 16, wherein the voltage response is representative of a local temperature of a circuit material where the PTAT generator is located.

* * * * *